US008944344B2

(12) United States Patent
Donaty

(10) Patent No.: US 8,944,344 B2
(45) Date of Patent: Feb. 3, 2015

(54) MULTI-ELEMENT ULTRASONIC ATOMIZER

(75) Inventor: Michael Donaty, Danbury, CT (US)

(73) Assignee: Sonics & Materials Inc., Newtown, CT (US)

( * ) Notice: Subject to any disclaimer, the term of this patent is extended or adjusted under 35 U.S.C. 154(b) by 837 days.

(21) Appl. No.: 12/498,875

(22) Filed: Jul. 7, 2009

(65) Prior Publication Data

US 2010/0108775 A1 May 6, 2010

Related U.S. Application Data

(60) Provisional application No. 61/078,836, filed on Jul. 8, 2008.

(51) Int. Cl.
*B05B 1/08* (2006.01)
*B05B 17/06* (2006.01)
*B05B 1/14* (2006.01)

(52) U.S. Cl.
CPC ..... *B05B 17/0623* (2013.01); *B05B 17/063* (2013.01); *B05B 1/14* (2013.01)
USPC ..... 239/102.1; 239/102.2

(58) Field of Classification Search
CPC ..... B05B 17/06; B05B 17/0607
USPC ..... 239/4, 1, 102.1, 102.2, 589.1
See application file for complete search history.

(56) References Cited

U.S. PATENT DOCUMENTS

| | | | | |
|---|---|---|---|---|
| 4,074,277 | A | 2/1978 | Lane et al. | |
| 4,496,101 | A * | 1/1985 | Northman | 239/102.2 |
| 4,742,810 | A | 5/1988 | Anders et al. | |
| 4,845,517 | A | 7/1989 | Temple et al. | |
| 4,978,067 | A * | 12/1990 | Berger et al. | 239/102.2 |
| 6,273,342 | B1 * | 8/2001 | Terada et al. | 239/102.2 |
| 6,764,720 | B2 | 7/2004 | Pui et al. | |
| 2003/0048038 | A1 | 3/2003 | Tsai | |
| 2008/0265055 | A1 * | 10/2008 | Quan et al. | 239/102.1 |

FOREIGN PATENT DOCUMENTS

WO 2005042177 A1 5/2005

OTHER PUBLICATIONS

International Search Report and Written Opinion of the International Searching Authority; PCT/US2009/049893; Nov. 24, 2009; 10 pages.

* cited by examiner

*Primary Examiner* — Davis Hwu
(74) *Attorney, Agent, or Firm* — St. Onge Steward Johnston & Reens LLC

(57) ABSTRACT

A multi-element ultrasonic atomizer and method for atomizing liquids is described, having a power generator, a converter, an ultrasonic horn coupled to the converter, and at least two atomizing probes coupled to the ultrasound horn, each atomizing probe including at least one liquid passage extending longitudinally along the atomizing probe and terminating at an atomizing tip at a distal end of the atomizing probe. The atomizing probes are made to vibrate at same frequency. A liquid is delivered to an atomizing surface through the liquid passage and through an opening at the atomizing tip.

20 Claims, 2 Drawing Sheets

MULTI-ELEMENT ULTRASONIC ATOMIZER

CROSS-REFERENCE TO RELATED APPLICATIONS

This application claims priority benefit of the U.S. Provisional application No. 61/078,836, filed on Jul. 8, 2008, which is incorporated by reference herein.

FIELD OF THE INVENTION

The present invention relates generally to ultrasonic devices, and more particularly, to a multi-element ultrasonic atomizer that is capable of atomizing multiple liquid samples simultaneously.

BACKGROUND OF THE INVENTION

There are hundreds of applications where there is a need of spray systems to apply or use the liquid efficiently. Many industrial applications require high volumes of liquids to be emulsified, dispersed, homogenized, and degassed while in the process line. This can be accomplished through use of atomizers. Atomization refers to the conversion of bulk liquid into a spray or mist (i.e. collection of drops), often by passing the liquid through a nozzle.

There are several types of spray nozzles known in the art, categorized based on the energy input used. The hydraulic spray nozzles use the liquid pressure as the energy source to break the liquid into droplets. With the increase of the fluid pressure, the flow also increases and the size of the fluid drop decreases. The gas atomized spray nozzles utilize a gaseous source to break the liquid to the droplets. The atomization is achieved by either breaking the liquid into droplets by using only gas, or by causing the liquid to come into contact with a surface to break the liquid stream and then mixing the air into it to atomize the liquid. External mixing nozzles mix fluids outside the nozzle. Sometimes a gas used to atomize a liquid may also react with the liquid, which in turn can cause damage the inside of the nozzle. Thus, this type of nozzle may prevent such damage to the nozzle by allowing mixing and atomization of liquid outside the nozzle.

Unlike these conventional atomizing nozzles that rely on pressure and high-velocity motion to shear a fluid into small drops, an ultrasonic atomizer uses only low ultrasonic vibration energy to break up water or any other liquid into small particles of a size from a few microns to hundreds of microns. A typical ultrasonic atomizer consists of an ultrasonic transducer for ultrasound generation, a reservoir for a liquid that is to be atomized and an ejection nozzle, also called a horn. A power supply supplies electrical energy to the transducer and causes it to oscillate at a certain ultrasonic frequency. This electrical oscillation passes to some type of converter, such as piezoelectric material, and is then converted into mechanical vibrations in the ultrasonic range. The resulting intensive mechanical vibrations produce a field of waves on the surface of a liquid, causing the velocity of the liquid particles in the waves to become so high that it overcomes the effects of gravity and surface tension forces and causes small particles to detach from the liquid surface into the air.

The size of the droplets produced by the ultrasound atomizer depends on properties of a liquid and on a particular ultrasound frequency used in the ultrasonic oscillator. The atomizing capacity of the ultrasound atomizer will typically depend on the size of the oscillating material that converts the electric vibrations into mechanical vibrations. The larger the size of the piezoelectric elements, the greater is the water atomizing capacity. The magnitude of the electrical power supplied to the ultrasound atomizer also effects to atomizing capacity.

One of the problems associated with conventional atomizers is that they generally use only a single spray-nozzle or probe and thus can only process one liquid sample at a time. The inability to increase the mass output from such single-probe atomizers presents a major challenge in industrial applications where large quantities of particles need to be delivered. Another drawback of conventional single-probe atomizers is that they require more labor because each sample of liquid has to be processed separately.

Attempts have been made to solve the problems associated with conventional atomizers by providing atomization systems that utilize multiple nozzles in attempt to increase the efficiency of such systems.

For example, U.S. Pat. No. 6,764,720 to Pui et al. describes an electrospray dispensing device comprising multiple nozzle structures for producing multiple sprays of particles. The sprays of particles are produced by creating a non-uniform electrical field between the nozzle structures and an electrode that is electrically isolated from the structures.

U.S. Pat. No. 4,845,517 to Temple et al. is directed to an ink jet "drop-on-demand" printer that has a number of parallel channels each containing ink. A mercury thread extends through each channel and is connected to electrical current flow. The current flow causes electromagnetic deformation of the mercury thread, which leads to a pressure pulse in the ink causing ejection of an ink droplet from a chosen channel.

U.S. Pat. No. 4,074,277 to Lane et al. discloses an ink jet synchronization scheme having multi-nozzle ink jet array, wherein the drop formation in each nozzle is synchronized acoustically by individual acoustic fiber input to each of the nozzles.

U.S. Pat. No. 4,742,810 to Anders et al. discloses an ultrasonic atomizer system designed to atomize and inject fuel into internal combustion engines. The system includes a housing with a pressure chamber, an ultrasonic vibrator that protrudes into the housing, and transport lines that transmit vibrations from pressure chamber to nozzles, from which the streams of fuel are ejected.

While the above described systems may have some advantages over the previously known systems, they are directed to different types of atomization systems having different applications than the ultrasonic atomizer of the present invention. For example, these prior art systems do not produce a low velocity mist as a result of atomization. Additionally, the above systems have somewhat complex structures, and are not designed for atomizing large quantities of liquids with reduced electric power consumption.

What is desired, therefore, is an improved ultrasonic atomizer probe that addresses tedious labor-intensive tasks required by conventional atomizing probes. It is further desired to provide an atomizing probe that maximizes productivity and efficiency at the lowest possible power supply.

SUMMARY OF THE INVENTION

Accordingly, it is an object of the present invention to provide an ultrasonic atomizer that overcomes the above problems.

It is a further object of the present invention to provide such an ultrasound atomizer that requires a reduced electric power consumption to atomize a larger amount of liquid.

It is a yet further object of the present invention to provide such an ultrasonic atomizer which is capable of processing many liquid samples simultaneously.

In order to achieve at least some of the objects listed above, a multi-element ultrasonic atomizer in provided, including a power generator, a converter, an ultrasonic horn coupled to the converter, and at least two atomizing probes coupled to the ultrasound horn, each atomizing probe comprising at least one liquid passage extending longitudinally along the atomizing probe and terminating at an atomizing tip at a distal end of the atomizing probe. The atomizing probes are made to vibrate at same frequency, and a liquid is delivered to an atomizing surface through the liquid passage and out of an opening at the atomizing tip.

In some embodiments, the converter may comprise a plurality of electrically excitable piezo elements. The power generator supplies an electrical oscillation to the converter, and the electrical oscillation is converted to a mechanical oscillation by the plurality of piezo elements. The mechanical oscillation is transferred from the converter to the ultrasonic horn, which then uniformly transfers the mechanical oscillation to the atomizing probes.

In certain embodiments, the atomizing probes may comprise a titanium alloy.

In certain embodiments, the ultrasonic horn may comprise a solid block of metal. In some of these embodiments, the metal may be a titanium alloy. In further embodiments, the ultrasonic horn may be rectangular in shape. The ultrasonic horn may also comprise at least one aperture for tuning the ultrasound horn and the two atomizing probes.

In some embodiments, the ultrasonic frequency may be in a range between 20 kHz to 40 kHz. In certain embodiments, a range of a median droplet size of the atomized liquid may be between 60 microns to 100 microns.

The liquid may be supplied to the atomizing probes through at least one inlet provided in each probe.

In certain embodiments, the converter and the ultrasonic horn may be detachably attached to one another.

In another embodiment, a method for atomizing liquids is provided, including the steps of supplying electrical power from a power generator, providing a converter for converting the electrical power to mechanical oscillation, transferring the mechanical oscillation to an ultrasonic horn coupled to the converter, transferring the mechanical oscillation from the ultrasonic horn to at least two atomizing probes coupled to the horn such that the probes oscillate at same frequency, and delivering a liquid to an atomizing surface through at least one liquid passage extending longitudinally along the atomizing probe and terminating at an atomizing tip at a distal end of the atomizing probe.

In some embodiments, the electrical oscillation may be converted to the mechanical oscillation by electrically excitable piezo elements positioned within the converter.

In certain embodiments, the atomizing probes may be made with a titanium alloy.

In some embodiments, the ultrasonic horn may be provided as a solid block of metal, and in certain embodiments, it may be rectangular in shape. The metal may be a titanium alloy.

In some embodiments, the method may further comprise the step of providing at least one aperture in the ultrasonic horn for tuning the ultrasound horn and the two atomizing probes.

The ultrasonic frequency of vibration is preferably in a range between 20 kHz to 40 kHz. A median droplet size of the atomized liquid produced by the method is preferably in a range between 60 microns to 100 microns.

In some embodiments, the liquid may be supplied to the atomizing probes through at least one inlet provided in each probe.

Other objects of the invention and its particular features and advantages will become more apparent from consideration of the following drawings and accompanying detailed description.

DETAILED DESCRIPTION OF THE INVENTION

Described herein is a multi-element ultrasonic atomizer that has significant advantages over conventional single-probe atomizers. The ultrasonic atomizer of the present invention is capable of processing many liquid samples simultaneously, while requiring a reduced electric power consumption to atomize a larger amount of liquid. The atomizer can be used to atomize a wide variety of coatings, chemicals, lubricants, and particulate suspensions.

Figure 1:
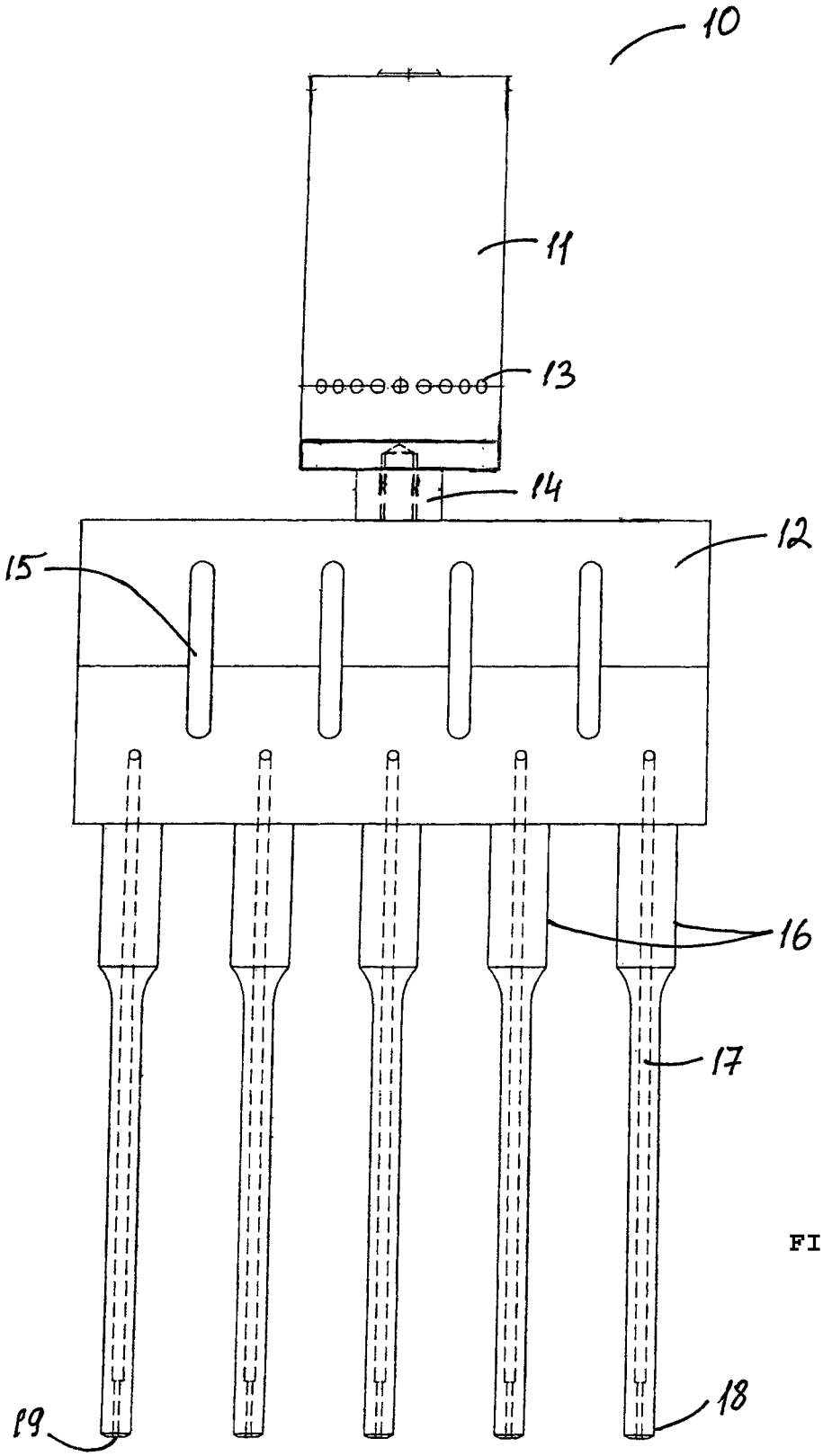
FIG. 1 illustrates a multi-element ultrasonic atomizer according to an exemplary embodiment of the present invention.

FIG. 1 illustrates an exemplary embodiment of the multi-element ultrasonic atomizer 10 in accordance with the present invention. The atomizer 10 is generally comprised of a converter 11, an ultrasonic horn 12 couples to the converter 11, and a plurality of atomizing probes 16 coupled to the ultrasonic horn 12.

The atomizer 10 utilizes a power generator (not shown) to convert typical AC electricity to high frequency electrical energy. The source of power may be either an accumulator or any known commercial power supply connection unit. The magnitude of the electrical power supplied to the atomizer 10 will affect the liquid atomizing capacity of the device. This high frequency electrical energy is then transmitted to the converter 11. In the exemplary embodiment, the converter 11 is provided with electrically excitable piezo elements 13. Various types of known piezoelectric materials may be used in accordance with the present invention, such as crystals and certain ceramics. The electrical energy causes the piezo elements 13 to expand and contract with each change of polarity. This oscillation of the piezo elements 13 in turn generates longitudinal mechanical vibrations in the ultrasonic range. The atomizing capacity of the atomizer 10 will also depend on the size of the oscillating piezo elements 13. For example, larger piezoelectric elements will produce greater liquid atomizing capacity.

These longitudinal vibrations are then fed from the converter 11 to the ultrasonic horn 12 through a coupler 14. According to the exemplary embodiment shown in FIG. 1, the horn 12 is a rectangular tuned assembly, onto which a plurality of atomizing probes 15 is secured. The ultrasound horn 12 functions to receive the mechanical vibrations from the converter 11 and to transfer the vibrations to the plurality of probes 16. The advantage of the present invention is that the horn 12 evenly distributes the energy delivered to each probe 15 and causes the probes 16 to vibrate at the same frequency, which in turn assures smooth and even distribution of the atomized liquid from each probe. Preferably, the ultrasonic horn 12 comprises a solid block of metal, such as a titanium alloy, although other suitable types of metals having good conducting qualities may be used as well. The horn 12 may also be provided with one or more apertures 15 for tuning the horn 12 and the atomizing probes 16.

The atomizing probes 15 may be fabricated from any known suitable material, for example, a titanium alloy, and are preferably autoclavable. The exemplary embodiment in FIG. 1 illustrates five atomizing probes 16 attached to the ultrasonic horn 12. However, the atomizer 10 of the present invention may also be provided with four, eight, sixteen or any other number of the atomizing probes. Each of the plurality of the atomizing probes 16 includes at least one liquid passage 17. The liquid passage 17 is a hollow tubular space within each solid probe 16 that extends longitudinally along the probe and terminates at an atomizing tip 18 at a distal end of the probe 16. Each probe 16 is further provided with at least one inlet 20, to which one or more supplies of liquid are connected to supply a liquid to the atomizer.

The liquid to be atomized is delivered to the plurality of probes 16 through the inlet 20 in each probe and flows down the liquid passage 17 in the probe toward an opening 19 at the atomizing tip 18. The ultrasonic vibrations projected from the ultrasonic horn 12 are intensified by the probes 16 and are focused at the atomizing tips 18 where atomization of the liquid takes place. These vibrations generate acoustic waves that are transmitted to the surface of the liquid contained in the liquid passages 17 in the plurality of probes 16. As the liquid travels through each probe along the liquid passage 17 toward the opening 19 at the atomizing tip 18, it spreads out as a thin film on the atomizing surface of each atomizing tip 18 and is then disintegrated into micro-droplets by the oscillating tip 18 to form a gentle, low velocity mist.

The ultrasonic frequency of oscillation of the atomizing probes 16 affects the drop size of the liquid that is delivered to the atomizing surface and thus, the frequency may be adjusted depending on the desired drop size. Generally, the higher the frequency, the smaller the drop size. The ultrasonic frequency of the multi-element ultrasonic atomizer 10 of the present invention is preferably in a range between 20 kHz to 40 kHz, and the median droplet size of the atomized liquid is preferably in a range between 60 microns to 100 microns.

One of the advantages of the present invention is that the ultrasound horn 12 with the plurality of probes 15 is compatible with various types of converters, and may be used either manually or with automated systems. The coupler 14 may be adapted to removably attach the ultrasound horn 12 to any type of the converter 11.

The liquid can be dispensed to each atomizing probe 16 by either gravity feed or a small low-pressure metering pump (not shown). The atomization process performed by the atomizer 10 of the present invention may be continuous or intermittent, depending on the application. The amount of material atomized can be as little as 2 μl/sec.

Because the velocity of the liquid droplets generated is very low, each of the plurality of probes 16 may be mounted with the atomizing tip 18 facing downward to take advantage of the gravitational force exerted on the atomized liquid. Air disturbances in the surrounding environment should preferably be minimized. Other factors such as viscosity, miscibility, and solid content of the atomized liquid should also be taken into consideration. For optimum atomization, the viscosity should preferably be below 60 cps and the solid concentration should preferably be kept below 30%.

Because the atomization process depends on setting a liquid film into motion, typically the more viscous the liquid, the more difficult the application. Thus, for example, the atomization of liquids containing long-chained polymer molecules may be problematic, even in a diluted form, due to a highly cohesive nature of the material. However, the ultrasonic atomizer of the present invention allows for atomization of even highly viscous mixtures with particulates because the low transport velocity of the liquid through the atomizing probes 16 permits even abrasive slurries to be processed with negligible erosion of the liquid passageways 17. The opening 19 at the atomizing tip 18 of each atomizing probe 16 is preferably made relatively large to prevent clogging of the opening 19 and the liquid passage 17 by viscous atomizing liquids.

It should be appreciated that each probe 15 may also have a dual inlet (not shown) connected to the liquid passage 17 within the probe 15 to allow simultaneous atomization of a mixture of two different types of liquids, for example an active ingredient and a coating layer in pharmaceutical applications. Each type of liquid is introduced into the liquid passage 17 through a separate inlet. Then, two liquids are mixed as they flow through the probe 15 down the liquid passage 17, and are ejected from the atomizing tip 18 as a homogeneous spray mixture. Furthermore, one inlet may be sealed when processing only one liquid or when atomizing pre-mixed materials.

The multi-element atomizing probe of the present invention can be used for a wide variety of applications, such as coating of non-woven fabric and paper, laboratory spray drying, injecting moisture into a gas stream, applying a minute amount of oil, fragrance or flavor onto a product, injecting small volume of reagents into a reactor, or any other industrial application wherein many liquid samples must be processes simultaneously with a reduced electric power consumption.

Figure 2:
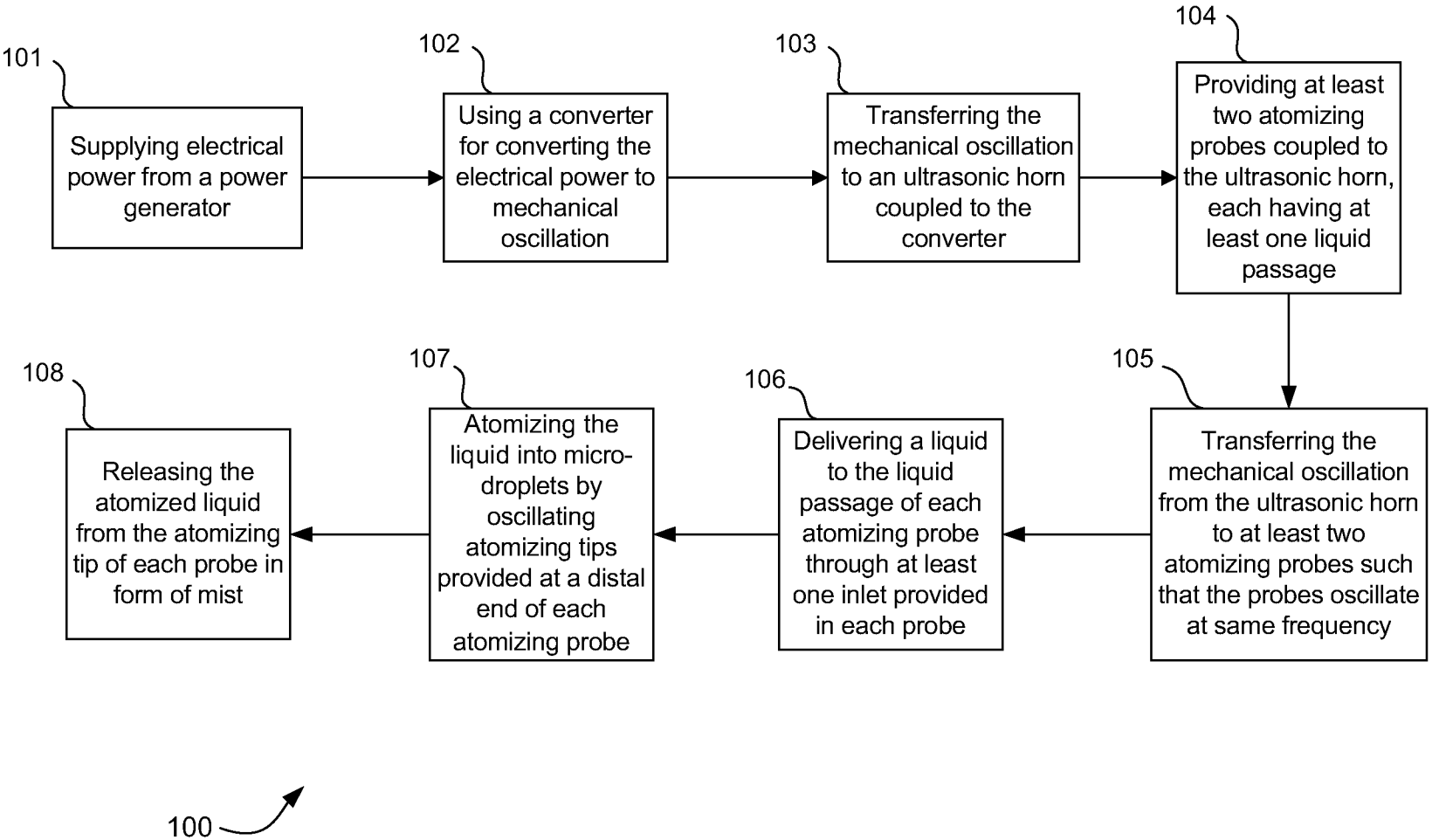
FIG. 2 illustrates a method for atomizing liquids in accordance with the present invention.

FIG. 2 illustrates a method for atomizing liquids in accordance with the present invention. First, electrical power is supplied from a power generator to a converter (step 101). The electrical power is then converted into mechanical oscillation (step 102) by piezoelectric elements positioned within the converter. This mechanical oscillation is transferred to an ultrasonic horn (step 103), which is removably attached to the converter by using a coupler. The ultrasonic horn has at least two atomizing probes attached thereto, and each atomizing probe is provided with a liquid passage that extends along a center axis of the atomizing probe and terminates at an atomizing tip at a distal end of the atomizing probe (step 104). The ultrasonic horn operates to uniformly transfer the mechanical oscillation from the converter to the atomizing probes such the probes oscillate at same frequency (step 105).

A liquid to be atomized is delivered to the liquid passage in each of the atomizing probes through at least one inlet provided in each probe (step 106). The liquid travels through the liquid passage in each atomizing probe toward the atomizing tip, where the mechanical oscillation reaches its highest intensity and atomization of the liquid takes place. The atomizing liquid is disintegrated into micro-droplets by the oscillating atomizing tips (step 107) and is released from the atomizing tip of each probe in form of a gentle, low velocity mist (step 108).

Although the invention has been described with reference to a particular arrangement of parts, features and the like, these are not intended to exhaust all possible arrangements or features, and indeed many other modifications and variations will be ascertainable to those of skill in the art.

What is claimed is:

1. A multi-element ultrasonic atomizer, comprising:

a power generator;

a converter;

an ultrasonic horn coupled to said converter; and at least two atomizing probes coupled to said ultrasound horn, each atomizing probe comprising at least one liquid passage extending longitudinally along the atomizing probe and terminating at an atomizing tip at a distal end of the atomizing probe;

wherein said at least two atomizing probes are made to vibrate at same frequency;

wherein a liquid is delivered to an atomizing surface through said at least one liquid passage and through an opening at said atomizing tip; and wherein said converter converts an electrical oscillation supplied by said power generator to a mechanical oscillation and transfers the mechanical oscillation to said ultrasonic horn.

2. The multi-element ultrasonic atomizer according to claim 1, wherein said ultrasonic horn, uniformly transfers the mechanical oscillation received from said converter to said at least two atomizing probes.

3. The multi-element ultrasonic atomizer according to claim 1, wherein said at least two atomizing probes comprise a titanium alloy.

4. The multi-element ultrasonic atomizer according to claim 1, wherein said ultrasonic horn comprises a solid block of metal.

5. The multi-element ultrasonic atomizer according to claim 1, wherein said ultrasonic horn is rectangular in shape.

6. The multi-element ultrasonic atomizer according to claim 4, wherein said metal comprises a titanium alloy.

7. The multi-element ultrasonic atomizer according to claim 1, wherein said ultrasonic horn comprises at least one aperture for tuning said ultrasound horn and said at least two atomizing probes.

8. The multi-element ultrasonic atomizer according to claim 1, wherein said ultrasonic frequency is preferably in a range between 20 kHz to 40 kHz.

9. The multi-element ultrasonic atomizer according to claim 1, wherein said liquid is supplied to said at least two atomizing probes through at least one inlet provided in each said probe.

10. The multi-element ultrasonic atomizer according to claim 1, wherein a median droplet size of said atomized liquid is preferably in a range between 60 microns to 100 microns.

11. The multi-element ultrasonic atomizer according to claim 1, wherein said converter and said ultrasonic horn are detachably attached to one another.

12. A method for atomizing liquids, comprising the steps of:

supplying electrical power from a power generator;

providing a converter for converting said electrical power to mechanical oscillation;

transferring the mechanical oscillation to an ultrasonic horn coupled to said converter;

transferring the mechanical oscillation from the ultrasonic horn to at least two atomizing probes coupled to said horn such that the probes oscillate at same frequency; and delivering a liquid to an atomizing surface through at least one liquid passage extending longitudinally along the atomizing probe and terminating at an atomizing tip at a distal end of the atomizing probe.

13. The method for atomizing liquids according to claim 12, whereby the electrical oscillation is converted to the mechanical oscillation by electrically excitable piezo elements positioned within said converter.

14. The method for atomizing liquids according to claim 12, wherein said at least two atomizing probes comprise a titanium alloy.

15. The method for atomizing liquids according to claim 12, wherein said ultrasonic horn comprises a solid block of metal.

16. The method for atomizing liquids according to claim 15, wherein said metal comprises a titanium alloy.

17. The method for atomizing liquids according to claim 12, further comprising the step of providing at least one aperture in the ultrasonic horn for tuning said ultrasound horn and said at least two atomizing probes.

18. The method for atomizing liquids according to claim 12, wherein said ultrasonic frequency is preferably in a range between 20 kHz to 40 kHz.

19. The method for atomizing liquids according to claim 12, whereby the liquid is supplied to said at least two atomizing probes through at least one inlet provided in each said probe.

20. The method for atomizing liquids according to claim 12, wherein a median droplet size of said atomized liquid is preferably in a range between 60 microns to 100 microns.

* * * * *